United States Patent [19]

Mayerböck et al.

[11] 4,319,415

[45] Mar. 16, 1982

[54] CUTTER HEAD FOR SUCTION DREDGES

[75] Inventors: Gottfried Mayerböck; Rupert Stöbl; Sebastian Seiler, all of Kapfenberg, Austria

[73] Assignee: Vereinigte Edelstahlwerke Aktiengesellschaft, Vienna, Austria

[21] Appl. No.: 115,494

[22] Filed: Jan. 25, 1980

[30] Foreign Application Priority Data

Feb. 2, 1979 [AT] Austria ..... 776/79

[51] Int. Cl.[3] ..... E02F 3/92

[52] U.S. Cl. ..... 37/67; 37/141 T

[58] Field of Search ..... 37/67, 141 R, 141 T, 37/142 R, 142 A

[56] References Cited

U.S. PATENT DOCUMENTS

| | | | |
|---|---|---|---|
| 775,770 | 11/1904 | Herrod, Jr. | 37/142 R X |
| 851,093 | 4/1907 | Kennedy | 37/142 R |
| 1,438,001 | 12/1922 | Van Buskirk et al. | 37/142 R |
| 1,783,350 | 12/1930 | Watts | 37/142 R |
| 1,903,123 | 3/1933 | Meyer | 37/141 T |
| 1,920,873 | 8/1933 | MacFadyen | 37/141 T |
| 3,808,716 | 5/1974 | Verbeck | 37/67 |

FOREIGN PATENT DOCUMENTS

| | | | |
|---|---|---|---|
| 7415416 | 3/1976 | Netherlands | 37/67 |

*Primary Examiner*—Clifford D. Crowder
*Attorney, Agent, or Firm*—Werner W. Kleeman

[57] ABSTRACT

A cutter head for a suction dredge, especially suction dredge vessels or barges, comprising cutter head blades and teeth holders each carrying a respective tooth tip with the teeth holders welded to the cutter head blades. Each tooth holder possesses at its end region, facing away from the tooth tip carried by the tooth holder, an essentially T-shaped or double T-shaped profile or sectional configuration. Each cutter head blade is provided with slots in which there is arranged a respective web of such sectional shape or profile.

3 Claims, 17 Drawing Figures

CUTTER HEAD FOR SUCTION DREDGES

BACKGROUND OF THE INVENTION

The present invention relates to a new and improved construction of a cutter or cutting head for suction dredges, especially suction dredge vessels or barges, which cutter head is of the type comprising cutter head blades to which there are welded teeth holders, each carrying a respective tooth tip, preferably on a respective support cone.

A cutter head of the previously mentioned type is already known to the art wherein the elongate structured tooth holder is flushly welded with the cutter head blade. With this cutter head, during operation, there not only arises tremendous wear at the tips of the teeth, but also at the tooth holders arranged in distributed fashion over the cutter head blades. The forces which arise during operation are basically exclusively transmitted by means of the connecting weld seam to the base metal or material. This, in turn, leads to the undesirable result that frequently the welding seam ruptures. When rewelding new teeth holders to the cutter head blades it is then practically impossible to carry out the welding operation such that the corresponding tooth holder, and therefore, also the related tooth tip assumes the same spatial position as was the case prior to the repair work. However, this is extremely important in order to insure for the operational efficiency of the cutter head. Moreover, it should be mentioned that the tooth holder deforms when encountering rugged working conditions and the corresponding cutter head thus becomes unusable.

SUMMARY OF THE INVENTION

Therefore, with the foregoing in mind it is a primary object of the present invention to provide a new and improved construction of cutter head for a suction dredge which is not afflicted with the aforementioned drawbacks and limitations of the piror art discussed above.

Another and more specific object of the present invention aims at overcoming the drawbacks discussed heretofore and, specifically, providing a new and improved construction of a cutter head whose tooth holders do not deform even when encountering rugged or heavy-duty working conditions, which tooth holders can be reliably connected with their associated cutter head blades and after welding or otherwise being appropriately affixed thereto positively remains in any event in their correct position.

Now in order to implement these and still further objects of the invention, which will become more readily apparent as the description proceeds, the cutter head of the previously mentioned type is manifested by the features that each tooth holder is provided at its end region, facing away from the tooth tip which is carried by such tooth holder, with an essentially T-shaped or double T-shaped profile or sectional shape. Moreover, each cutter head blade is provided with slots in which there is arranged a respective web of such profile or sectional shape. Under the herein employed terminology "essentially T-shaped or double T-shaped profiles or sectional shapes" as used in the context of this disclosure and as intended to be embraced by the invention, there are also to be understood such profile or sectional shapes whose flange or flanges do not extend perpendicular, rather at an inclination to the related web.

In contrast to the heretofore known cutter heads the inventive cutter head especially affords the advantage that its tooth holders are not deformed even when encountering heavy-duty or rugged working conditions and they can be reliably connected with the related cutter head blade. By virtue of the slots provided with the inventive cutter head it is insured that after replacement of a tooth holder by a new tooth holder the latter will be disposed at the correct location of the cutter head.

A particular dimensional stability of the tooth holder can be realized with the inventive cutter head in that, the relevant tooth holder is provided with one or a number of reinforcement ribs or equivalent structure. In this regard it has been found to be advantageous if there is provided at a tooth holder having a double T-shaped profile, at the side of a flange thereof facing away from the web, a reinforcement rib which is approximately in alignment with the web and is located at the side facing away from the related tooth tip and protrudes past such flange.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
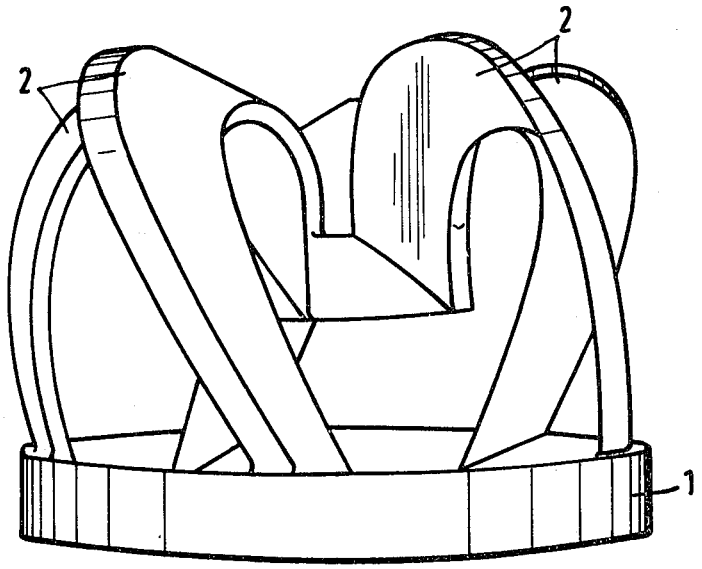
FIG. 1 is an end view of a cutter head for a suction dredge of a suction dredge vessel or barge containing cutter head blades, but omitting the slots, tooth holders and tooth tips in order to simplify the illustration.
Figure 2:
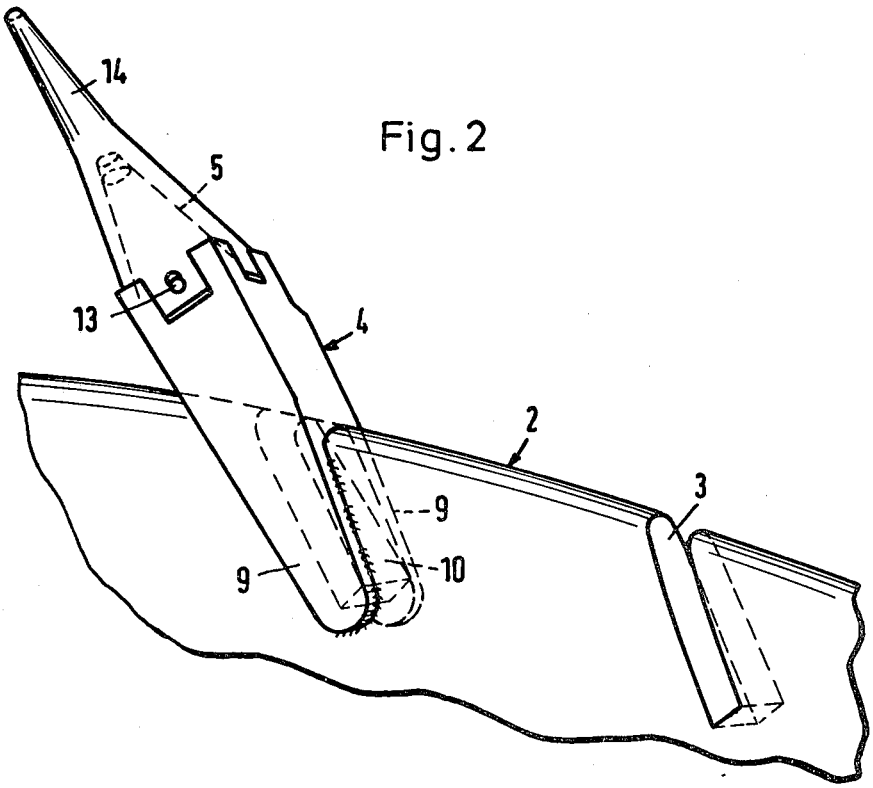
FIG. 2 is a fragmentary detailed view of a cutter head blade of the type shown in FIG. 1, illustrating a tooth holder and a tooth tip in side view.
Figure 3:
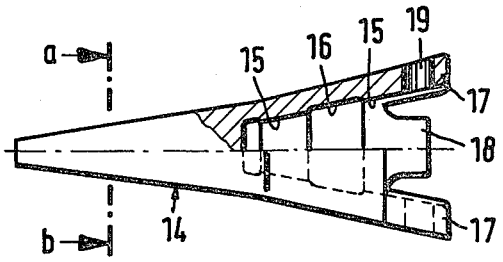
FIG. 3 is an end view of the tooth tip, partially shown in section and illustrating details thereof.

Describing now the drawings, the cutter head as shown in FIGS. 1 and 2 will be seen to comprise a substantially circular flange 1 to which there are welded or otherwise suitably affixed spatially curved cutter head blades 2 or equivalent structure and such cutter head rotates about its lengthwise axis when the suction dredge is in operation. Connected with the cutter head blades 2 are the respective tooth holders 4 each carrying a tooth tip or tooth element 14 or the like. Each tooth holder 4 is provided at its end region, facing away from the tooth tip or element 14 carried thereby, with a substantially T-configured sectional shape, here shown by way of example as a double T-shaped profile or sectional shape, —although a simple T-shape also can be used—the web 10 of which is located in a slot or slot means 3 of one of the related cutter head blades 2, as best seen by referring to FIG. 2. The cutter head blades 2 and the tooth holders 4 and the tooth tips 14 are advantageously fabricated of a high strength heat-treatable steel, for instance the cutter head blades 2 can be fabricated for instance from ASTM-A 27 steel, whereas for the tooth holders 4 and the tooth tips 14 there advantageously can be used steel formed according to the standard ASTM-A 148.

Both of the flanges 9 of the double T-shaped profile or sectional shape of the tooth holders 4 are welded or otherwise suitably affixed at predetermined locations at the related cutter head blade 2.

The tooth tip or element 14, illustrated in FIGS. 3 to 8 on an enlarged scale, will be seen to contain at its inner surface or side a substantially conical fitting surface 15 interrupted by a recess 16, by means of which the tooth tip 14, following its assembly at the support cone or element 5 of the related tooth holder 4 to be described more fully hereinafter, is seated upon its tooth holder 4. The tooth tip 14 is provided at the region of the fitting surface 15 with four attachment flaps or tongues 17 and 18 which are mutually offset from one another by 90°. In particular, there are provided two oppositely situated longer attachment flaps or tongues 17 and two oppositely situated shorter attachment flaps or tongues 18. The longer attachment flaps or tongues 17 are each provided with a respective elongate hole 19. The tooth tip 14 continuously tapers away from the region of the attachment flaps or tongues 17 and 18 towards the other free end thereof.

Figure 5:
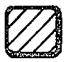
FIGS. 5, 6, 7 and 8 illustrate respective possible sectional shapes or profiles of the tooth tip of FIGS. 3 and 4, the sectional illustrations being taken substantially along the line a–b of FIG. 3.
Figure 6:
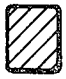
Figure 7:
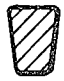
Figure 8:
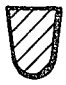
Figure 4:
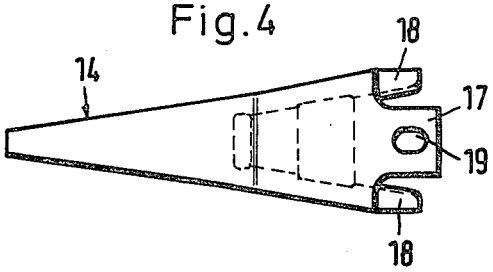
FIG. 4 is a top plan view of the tooth tip shown in FIG. 3.

As best seen by referring to FIGS. 5 to 8, the tooth tip 14 can be alternately structured so as to have different sectional shapes or profiles. Specifically, as shown in FIG. 5 it can have a square sectional shape, as shown in FIG. 6 a rectangular sectional shape, as shown in FIG. 7 a trapezoidal sectional shape, and as shown in FIG. 8 a sectional shape which is bounded by three essentially straight surfaces and an arcuate surface and tapering in the direction of the arcuate surface.

Figure 9:
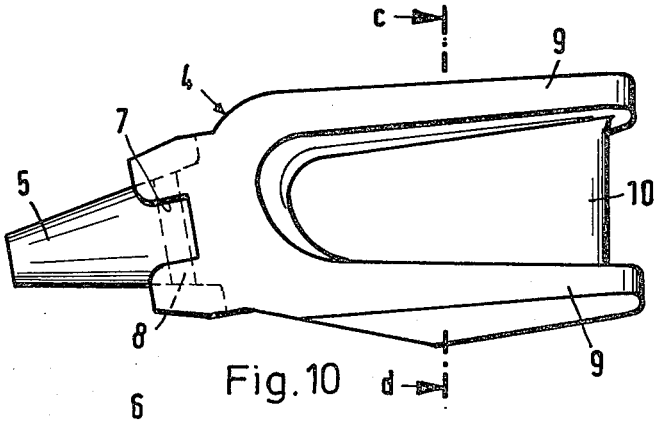
FIG. 9 is a view of a modified construction of tooth holder.
Figure 11:
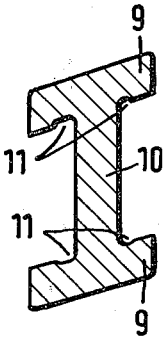
FIG. 11 is a sectional view of the tooth holder of FIG. 9, taken substantially along the line c–d thereof.
Figure 10:
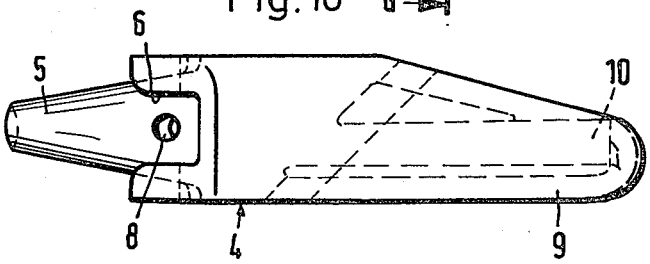
FIG. 10 is a top plan view of the tooth holder of FIG. 9.

The construction of tooth holder 4, as illustrated in detail in FIGS. 9, 10 and 11, and operatively related with a corresponding one of the tooth tips or elements 14, will be seen to comprise at the region of its support cone or element 5 a total of four recesses or depressions 6 and 7 in which, following the assembly of the tooth tip 14 with the tooth holder 4, there engage the attachment flaps or tongues 17 and 18 of the tooth tip 14 which is mounted upon the support cone 5. In this respect attention is also directed to FIG. 2. The mounted or assembled tooth tip 14 is secured at the related tooth holder 4 by means of a pin 13 or equivalent structure which piercingly extends through the previously mentioned elongate holes 19 and a hole or aperture 8 provided at the support cone or element 5. The tooth holder 4 has an essentially double T-shaped profile or sectional shape at the end region facing away from its support cone 5, and the flanges 9 of the double T-shaped profile do not extend perpendicular, rather somewhat at an inclination to the profile web 10. Moreover, each of these flanges 9 is provided at a location following the web 10 with a respective recess or depression 11 having a substantially semi-circular cross-sectional configuration. The web 10 extends practically up to the ends of the flanges 9 which face away from the support cone 5. As illustrated in FIG. 10 the flanges 9 taper towards such ends. The imaginary lengthwise axis of the support cone 5 is somewhat inclined with relation to the flanges 9.

Figure 12:
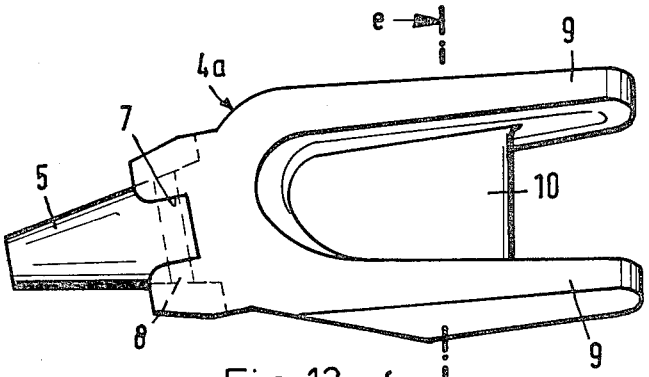
FIG. 12 illustrates a further embodiment of tooth holder.
Figure 14:
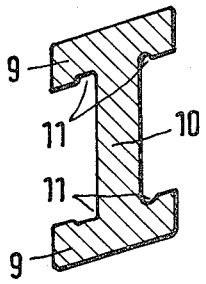
FIG. 14 is a sectional view of the tooth holder of FIG. 12, taken substantially along the line e–f thereof.
Figure 13:
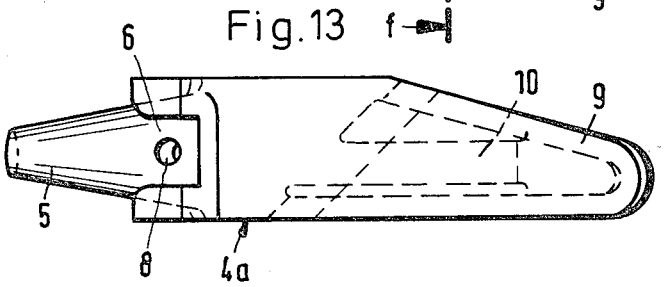
FIG. 13 is a top plan view of the tooth holder of FIG. 12.

As to the modified construction of tooth holder **4*a* shown in FIGS. 12, 13 and 14, the same differs from the tooth holder 4 described above and illustrated in FIGS. 9, 10 and 11, only in that with the tooth holder 4*a* of FIGS. 12 to 14 the web 10 is shorter in the lengthwise direction of the tooth holder 4*a*, i.e. the spacing at the end of the web 10 from the ends of the flanges 9 facing away from the support cone 5 is greater than with the first mentioned embodiment of FIGS. 9 to 11**.

Figure 15:
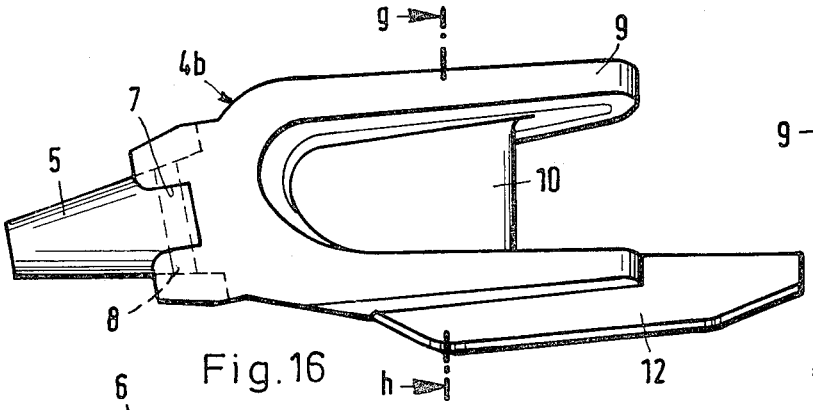
FIG. 15 illustrates a still further embodiment of tooth holder.
Figure 17:
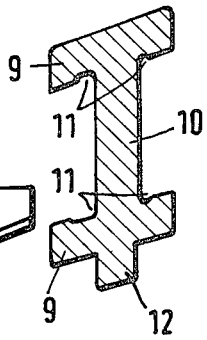
FIG. 17 is a sectional view of the tooth holder of FIG. 15, taken substantially along the line g–h thereof.
Figure 16:
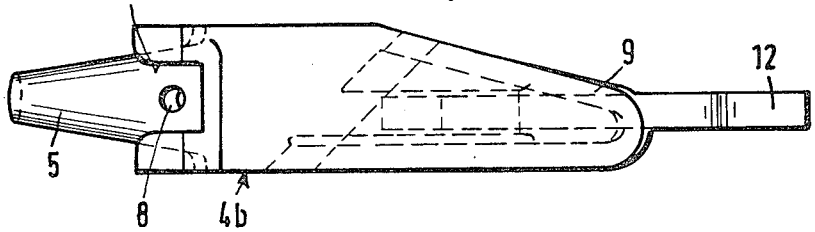
FIG. 16 is a top plan view of the tooth holder of FIG. 15.

In contrast to the construction of tooth holders 4 and **4*a* of FIGS. 9 to 14, with the still further modified construction of tooth holder 4*b* illustrated in FIGS. 15, 16 and 17 there is provided a reinforcement rib 12 or equivalent structure at the side of one of the flanges 9 facing away from the web 10. This reinforcement rib 12 is approximately in alignment with the web 10 and at the side facing away from the support cone or element 5 such reinforcement rib 12** protrudes past such flange.

Since otherwise the different embodiments of tooth holders 4, **4*a* and 4*b* of FIGS. 9 to 17** are essentially of the same construction the same elements have been conveniently designated throughout with the same reference characters. Finally, it is mentioned that the term "T-configured sectional shape", as used herein, is intended to encompass an essentially T- or double T-shaped profile or sectional shape and the herein disclosed modifications thereof.

While there are shown and described present preferred embodiments of the invention, it is to be distinctly understood that the invention is not limited thereto, but may be otherwise variously embodied and practiced within the scope of the following claims. Accordingly,

What we claim is:

1. A cutter head for a suction dredge, especially suction dredge vessels or the like, comprising:

cutter head blade means;

tooth holders welded to the cutter head blade means;

a respective tooth tip carried by a related one of the tooth holders;

each tooth holder having an end region facing away from the tooth tip carried thereby;

said end region having a substantially T-configured profile;

said profile having a web and at least one flange;

each cutter head blade means being provided with slot means for receiving the web of the profile of the related tooth holder;

said slot means coacting with the web of each mounted tooth holder so as to ensure that any subsequently mounted tooth holder and its tooth tip each time will assume an essentially exactly predetermined seated position at the cutter head blade means;

said substantially T-configured profile comprises a double T-shaped profile;

said flange being provided with a reinforcement rib at the side of the flange facing away from the web; and said reinforcement rib protruding outwardly from said side of the flange facing away from the web and protruding beyond a side of the flange in a direction away from the related tooth tip past such flange, said rib having a thickness less than said flange.

2. The cutter head as defined in claim 1, wherein: each tooth holder is provided with at least one recess.

3. A cutter head for a suction dredge, especially suction dredge vessels or the like, comprising:

cutter head blade means;

tooth holders affixed to the cutter head blade means;

a respective tooth element carried by a related one of the tooth holders;

each tooth holder having an end region facing away from the tooth element carried thereby;

said end region having a substantially T-shaped or double T-shaped profile;

each said profile having a web and at least one flange;

each cutter head blade means being provided with slot means for receiving the web of the profile of the related tooth holder;

said slot means coacting with the web of each mounted tooth holder so as to ensure that any subsequently mounted tooth holder and its tooth tip each time will assume an essentially exactly predetermined seated position at the cutter head blade means;

said flange being provided with a reinforcement rib at the side of the flange facing away from the web; and said reinforcement rib protruding outwardly from said side of the flange facing away from the web and protruding beyond a side of the flange in a direction away from the related tooth tip past such flange, said rib having a thickness less than said flange.

* * * * *